US005639338A

United States Patent [19]

Beckamnn

[11] Patent Number: 5,639,338

[45] Date of Patent: Jun. 17, 1997

[54] SPLICER FOR WEBS OF PACKAGING MATERIAL WOUND ONTO BOBBINS

[75] Inventor: Harald Beckamnn, Gevelsberg, Germany

[73] Assignee: Maschinenfabrik Alfred Schmermund GmbH & Co., Gevelsberg, Germany

[21] Appl. No.: 542,618

[22] Filed: Oct. 13, 1995

[30] Foreign Application Priority Data

Oct. 14, 1994 [DE] Germany ..... 44 36 719.8

[51] Int. Cl.[6] ..... B65H 21/00

[52] U.S. Cl. ..... 156/504; 156/159; 156/502; 156/509; 242/555.2; 242/555.6; 242/556

[58] Field of Search ..... 156/159, 502, 156/504, 505, 509; 242/553, 555, 555.1, 555.2, 555.6, 556, 556.1

[56] References Cited

U.S. PATENT DOCUMENTS

| | | | |
|---|---|---|---|
| 3,654,035 | 4/1972 | Takimoto | 156/505 |
| 3,939,031 | 2/1976 | Takimoto | 156/505 |
| 4,315,794 | 2/1982 | Palmieri | 156/504 |
| 5,337,456 | 8/1994 | Clement | 242/553 X |

FOREIGN PATENT DOCUMENTS

| | | |
|---|---|---|
| 3515643 | 10/1986 | Germany . |
| 3929981 | 3/1991 | Germany . |
| 9016526 | 4/1991 | Germany . |
| 2003119 | 3/1979 | United Kingdom . |
| 2181414 | 4/1987 | United Kingdom . |

*Primary Examiner*—Mark A. Osele
*Attorney, Agent, or Firm*—Chilton, Alix & Van Kirk

[57] ABSTRACT

An apparatus for splicing webs with little or no reduction in the operating speed. The apparatus includes a first pivoting member and a fixed opposing element, a second pivoting member which pivots about the same axis as the first pivoting member, a pair of nipping rollers mounted on the pivoting circle of an outer surface of the second pivoting member, a splicing device for the webs, a device for guiding the second web between the second pivoting member and the opposing element, and a cutting device for excess web material. The apparatus first guides the second web between the second pivoting member and the opposing element. Thereafter the second pivoting member and the opposing element converge to clamp the second web therebetween and an adhesive is applied to the second web. Next the first pivoting member pivots such that the second pivoting member, the opposing element, and the second web work in cooperation to contact the first web to the second web for splicing. The nipping rollers, second pivoting member, and opposing element cooperate to pinch the webs together to aid in splicing. The excess portions of both webs are cut and removed.

20 Claims, 5 Drawing Sheets

SPLICER FOR WEBS OF PACKAGING MATERIAL WOUND ONTO BOBBINS

BACKGROUND OF THE INVENTION

1. Field of the Invention

The present invention relates to the packaging of products and, more particularly, to the splicing of webs of packaging material which have been wound onto bobbins of cigarette packaging machines. More specifically, the present invention is directed to apparatus for splicing webs of packaging material at normal withdrawal speeds without manual intervention and without any reduction of packaging speed. Accordingly, the general objects of the present invention are to provide novel and improved apparatus and methods of such character.

2. Description of the Prior Art

Packaging machines employing one or more supply bobbins for packaging material in web format are well known in the art. In the prior art machines, the web of packaging material is typically unwound from an active supply bobbin at a high rate of speed and routed, via one or more rollers, to a remote location where wrapping of the product to be packaged occurs. Since these packaging machines are typically used near the final station of an assembly line, smooth and efficient operation of the entire assembly line demands that the packaging machine be able to operate with sufficient speed to keep up with the supply of products from the earlier stages of the assembly line. Thus, any slow down of the packaging operation can have adverse consequences on the efficiency of the entire assembly line.

Packaging machines were originally developed for use with a single bobbin for supplying the packaging material. In these machines, the web of packaging material was dispensed from the bobbin until the bobbin was exhausted. One major drawback of the more primitive of these early bobbin-type packaging machines is that the machine would invariably have to be shut down when the web of packaging material became completely unwound from the bobbin. After the packaging machine had been shut down, the empty bobbin could then be removed from the packaging machine and replaced with a fresh bobbin having a new roll of packaging material. Once the new roll of packaging material had been loaded onto the packaging machine, the packaging of products could once again resume at a normal rate. However, as mentioned above, the shut down time of the packaging machine resulted in significant reduction in the efficiency, and a concomitant interruption, of the entire assembly line. Thus, a need existed for a packaging machine in which the web of packaging material could be replaced with a new web of packaging material with little or no stoppage of the packaging process. This need has resulted in the development of packaging machines employing a plurality of bobbins, each having a web of packaging material wound thereon, and a splicing apparatus for automated switch-over to a full bobbin of packaging material when most of the web of packaging material was unwound from the active bobbin.

One device which attempts to achieve bobbin replacement with little or no interruption of the packaging operation is disclosed in German Patent 39 29 981. In this device the transition from the nearly exhausted bobbin of packaging material to a full bobbin is achieved by splicing the leading end of a new web of packaging material on a full bobbin to the web being withdrawn from the nearly exhausted bobbin. In this device, the new web of packaging material to be spliced is held ahead of one or more nipping rollers by a clamping strip and a cut out in an adjacent nipping roller. When splicing is to occur, the clamping strip releases the new web of packaging material and the nipping rollers grip the end of the new web with a friction section. However, in order for effective splicing to occur with the device of German Patent 39 29 981, the operating speed of the packaging machine must be greatly reduced. This speed reduction results in a loss of packaging efficiency, albeit to a lesser degree, in the same manner as experienced with a single bobbin machine. Thus, although this device does reduce the inefficiencies associated with bobbin replacement in packaging machines, it has, by no means, eliminated the problem altogether.

SUMMARY OF THE INVENTION

The present invention overcomes the above-discussed disadvantages and other deficiencies of the prior art by joining a nearly exhausted web of packaging material to the leading edge of new web of packaging material without the need for manual intervention and with little or no reduction in the product through-put rate of a packaging process.

Apparatus in accordance with the present invention comprises a splicer which includes a first pivoting member, an opposing element which is in fixed relation to the first pivoting member, a second pivoting member which pivots about the same axis as the first pivoting member, at least one nipping roller which is mounted to the packaging machine on the pivoting circle of the first pivoting member and a device for feeding the leading end of a web of packaging material between the second pivoting member and the opposing element. In their initial positions, the second pivoting member and the opposing element are in spaced relation to one another thereby defining a gap therebetween. At the beginning of a splicing operation the device for feeding the leading end of a new web of packaging material between the second pivoting member and the opposing element passes the web of packaging material through this gap. The second pivoting member and the opposing element then converge to a clamping position wherein they cooperate to clamp the new web therebetween and an adhesive is applied to one surface of the new web. The combination of the second pivoting member, the opposing element, and the new web of packaging material then pivots such that the new web of packaging material is brought into substantially tangential contact with the other web (i.e. the old nearly exhausted web) of packaging material at substantially the same rate of speed as the old web of packaging material is moving. The nipping rollers provide sufficient pressure to aid bonding between the old and new webs of packaging material thereby forming a splice. The excess portions of both webs of packaging material are cut and removed for disposal. Thus, the transition from the nearly exhausted web of packaging material to the new web of packaging material can occur with little or no reduction in the operating speed of the packaging machine. Since the new bobbin now supplies the web of packaging material for the packaging process, the old bobbin can be replaced with a fresh bobbin and eventually the web of packaging material on the newly replaced bobbin can be spliced onto the other yet another web of packaging material when it too becomes nearly exhausted. Thus, a packaging machine employing the present invention can continuously supply packaging material and completely avoid the need for slowing or stopping the entire assembly line as was heretofore necessary.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DETAILED DESCRIPTION OF THE DISCLOSED EMBODIMENT

Figure 1:
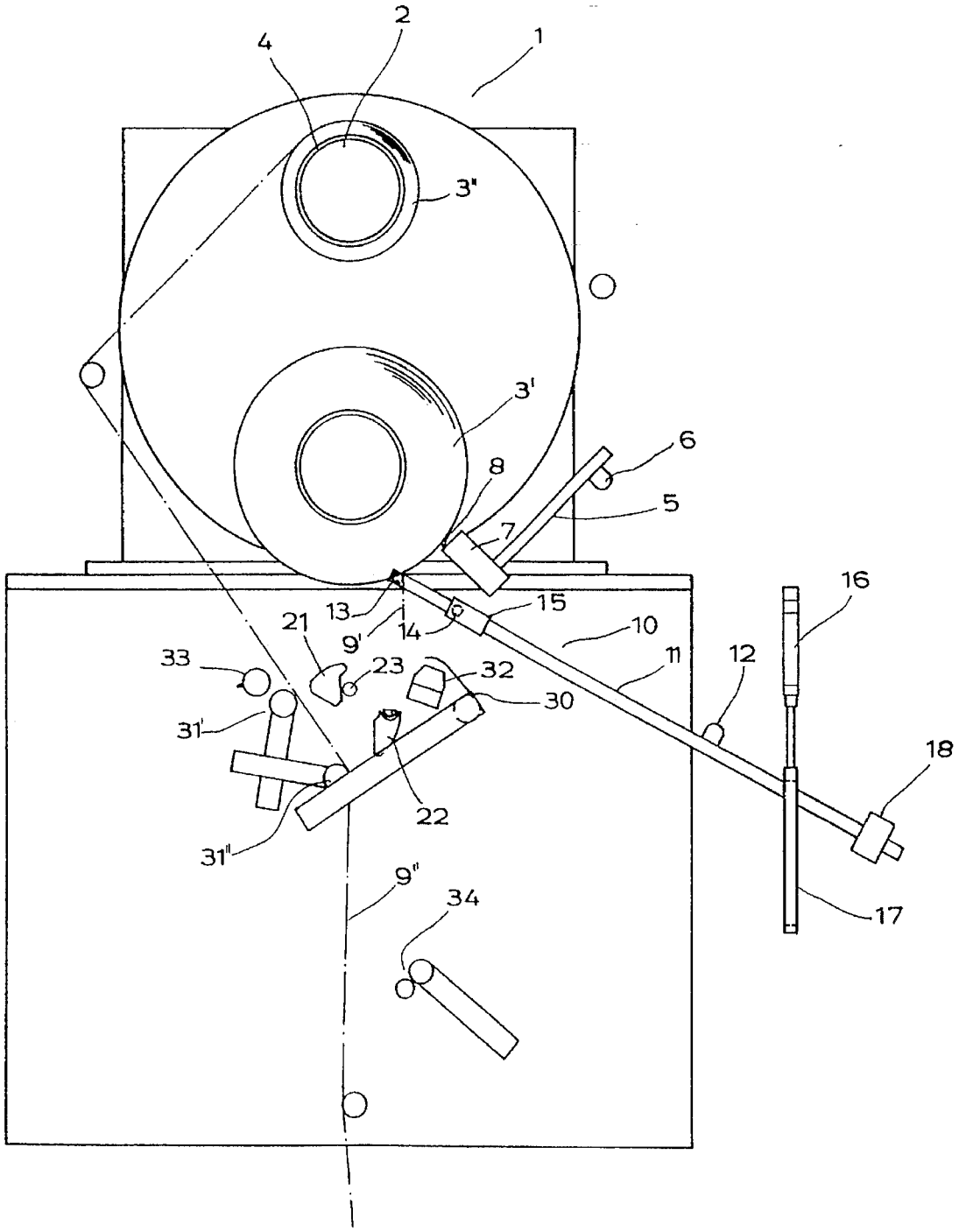
FIG. 1 is a schematic representation of a splicer in accordance with the present invention in the environment of a packaging machine.
Figure 2:
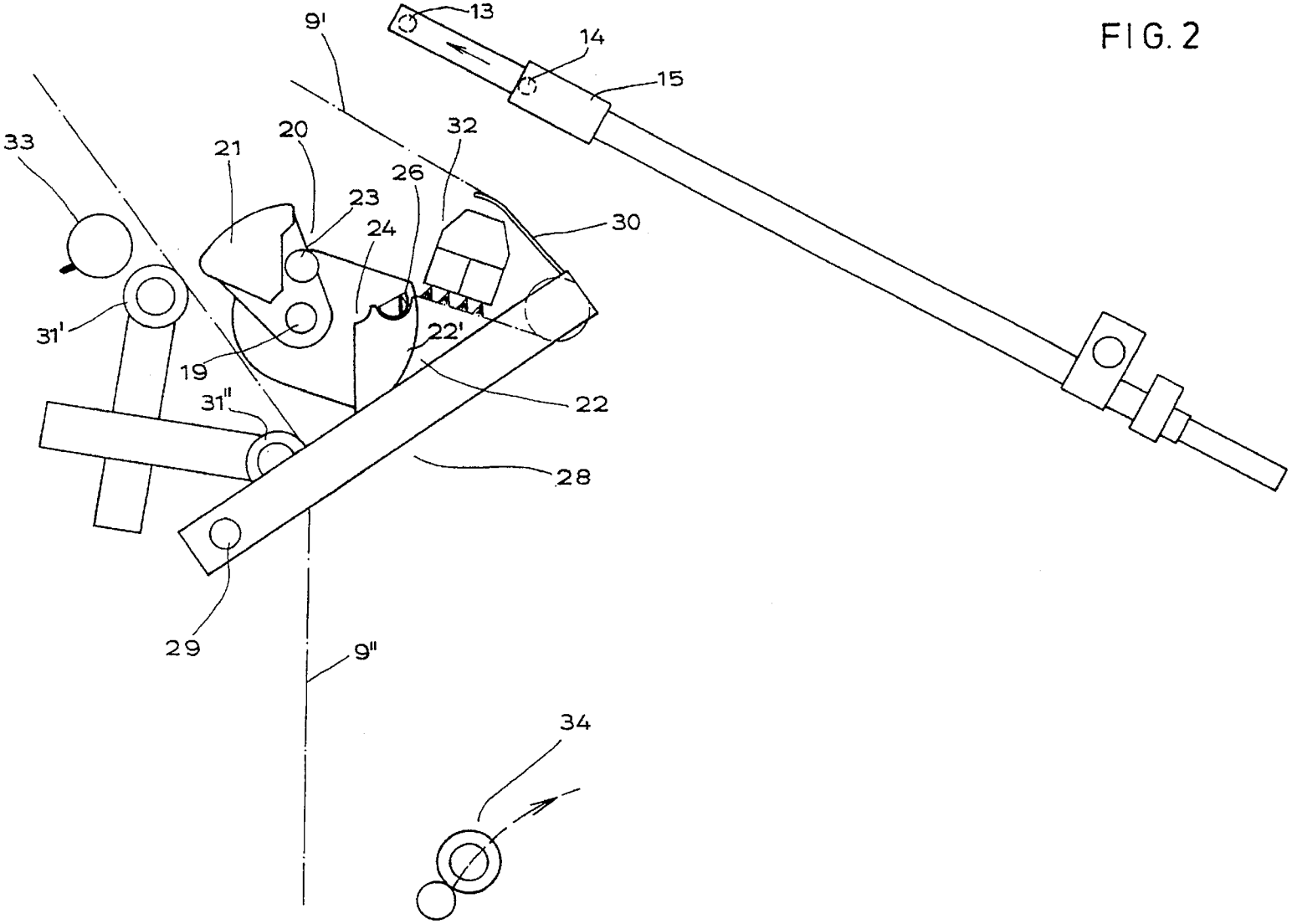
FIG. 2 is a more detailed view of the splicer depicted in FIG. 1.

A splicer in accordance with the present invention is shown schematically in FIG. 1 in combination with a packaging machine. A turntable 1 is located near the top of the packaging machine and the packaging machine has a drive mechanism (not illustrated) for rotating turntable 1 in either direction. A first holding journal 2 is located near the perimeter of turntable 1. A second holding journal, which is substantially similar to the first holding journal 2, is also located near the perimeter of turntable 1 but, in the disclosed embodiment, is generally diametrically opposed to holding journal 2. A first bobbin 3", with a bobbin core 4, is clamped to holding journal 2 for rotation thereon. A second bobbin 3' is clamped to the second holding journal in a similar fashion. For purposes of explanation, first bobbin 3" has been shown in the nearly exhausted state. Bobbin 3", with a web of packaging material 9" in roll form stored thereon, rotates about an axis which is oriented substantially parallel to the axis of rotation of second bobbin 3' which has a new web of packaging material 9' disposed thereon. First and second bobbins 3" and 3' can be wound with a web of any of the many well known packaging materials such as paper, foil, or a plastic film and equivalents thereof.

In order to splice the leading end of the new web 9' of packaging material to the old web 9", the leading end of web 9' must first be separated from the remainder of the roll on bobbin 3'. While there presently exist many devices and methods for lifting the leading edge which are compatible with the present invention, only one will be described below. As shown in FIG. 1, the means for lifting the leading end of web 9' includes a lever 5 which pivots about an axis 6 and has a freely movable slide 7 at one end thereof. Slide 7 has a knife 8 on one end thereof. To lift the end of web 9', lever 5 is rotated about axis 6 so that knife 8 of slide 7 approaches the outer surface of the roll of web 9'. When knife 8 makes initial contact with web 9', the leading end of web 9' will be engaged thereby and lifted off of the surface of the roll. As an alternative, a radially displaceable friction body can be used to engage and lift the leading edge of web 9' from the roll. Additionally, compressed air can be directed along the surface of web 9' with either constant or varying intensity to assist separation of the leading end of web 9' from the remainder of the roll. However, regardless of the method used to lift the leading edge of web 9', when the leading end of web 9' is lifted from the rest of web 9', it will be engaged by a web-material gripper 10.

Figure 3:
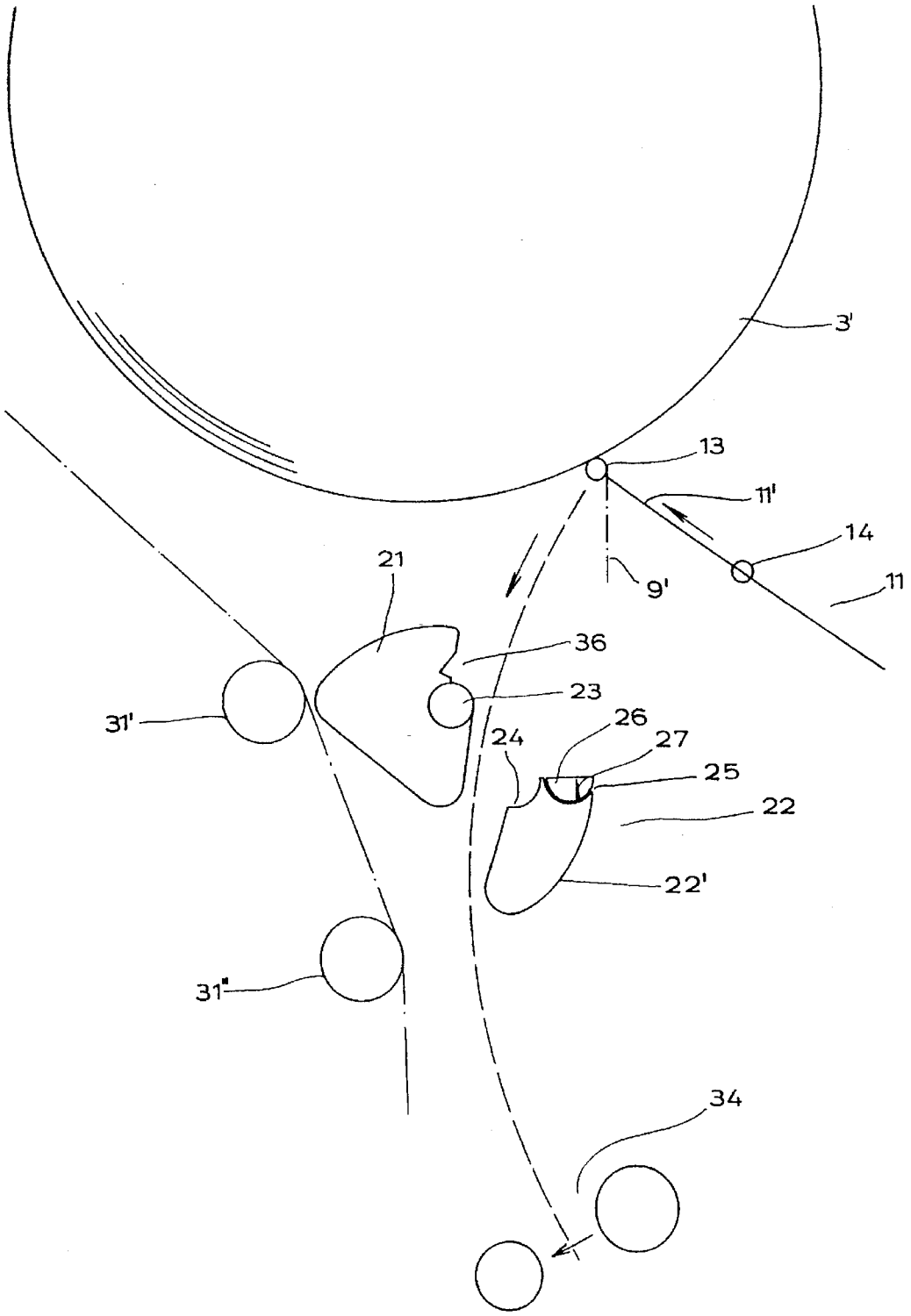
FIGS. 3, 4, and 5 illustrate the method of splicing two webs of packaging material together implemented by the splicer depicted in FIGS. 1 and 2.

Referring to now to FIGS. 1 and 3, web-material gripper 10 includes a lever 11 which is pivotably mounted for rotation about an axis 12 between two end positions. In the first position, a roller 13, which is located at a free end of an arm 11' of lever 11, rests against the outer surface of web 9'. A second roller 14 is supported on a freely movable slide 15 with its axis of rotation substantially parallel to that of roller 13. When the leading end of web 9' has been lifted off of bobbin 3' the leading end of web 9' falls in the gap between rollers 13 and 14. Slide 15 then moves along arm 11' toward roller 13 until the leading end of web 9' is pinched between roller 13 and roller 14. Optionally, other known gripping means can be employed to clamp the leading end of web 9' to roller 13.

A cylinder 16 and a forked element 17 connected to cylinder 16 are used to cause lever 11 to pivot about axis 12. In an initial position, one end of lever 11 is received within forked element 17 such that a counter weight 18 on lever 11 urges roller 13 against the outer surface of web 9'. After the leading edge of web 9' has been clamped between rollers 13 and 14, cylinder 16 causes vertical displacement of forked piece 17 such that arm 11' can pivot downward about axis 12 pulling the leading edge of web 9' downward with it.

As the leading edge of web 9' is guided downwardly via the movement of lever 11, it passes through the gap between a circular cylindrical segment 21, which is rotatably supported on a disc member 20, and an opposing element 22 which is also mounted on member 20. Member 20 and segment 21 are rotatable about an axle 19 having an axis which extends generally perpendicular to the transporting plane of webs of 9' and 9". This transporting plane is defined as the plane through which webs 9' and 9" move as they are unwound from bobbins 3' and 3" respectively. The relationship between opposing element 22 and disc member 20 is fixed while segment 21 is rotatable independently of disc member 20. Preferably, the outer surface of segment 21 defines a partial cylindrical surface where the cylinder has a radius equal to the distance between pivot axis 19 and the outer surface of segment 21. Additionally, a friction roller 23 is mounted on segment 21. Friction roller 23 rotates about an axis which is substantially parallel to axis 19.

Figure 4:
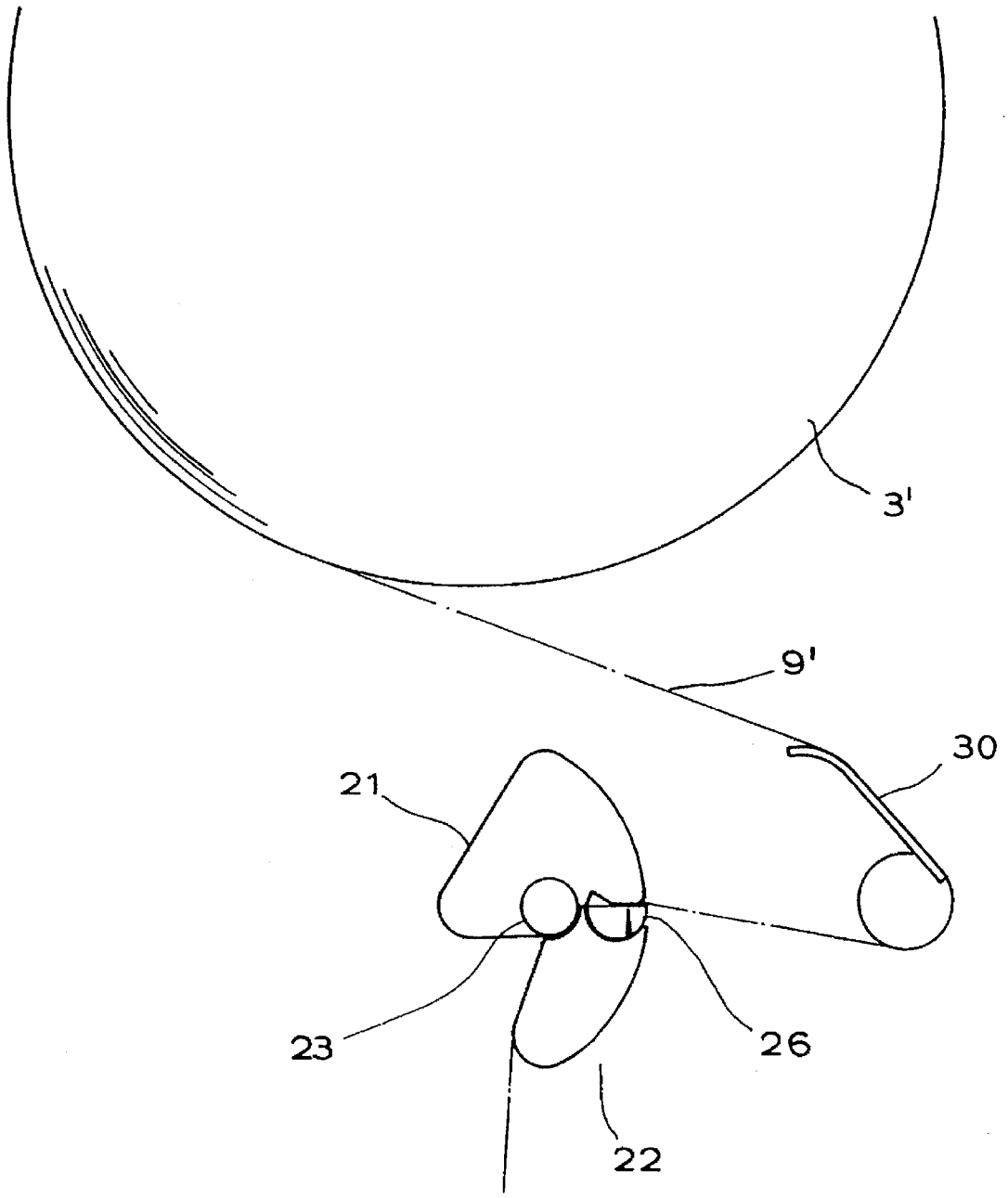

Opposing element 22 has a complementary partially cylindrically shaped indented region 24 for engagement with friction roller 23. As segment 21 and opposing element 22 are moved from the initial position depicted in FIG. 3 to a clamping position as represented by FIG. 4, the leading end of web 9' is clamped between the surface of friction roller 23 and complementary surface 24. Opposing element 22 has an outer surface 22' which, like the outer surface of segment 21, defines a partial cylindrical surface where the cylinder has a radius equal to the distance between axis 19 and the edge of outer surface 22'. Thus, surface 22' forms a cylindrical extension of the outer surface of segment 21 when segment 21 and opposing element 22 are in the clamping position. In other words, the outer surface of segment 21 and the outer surface of 22' of opposing element 22 cooperate to define a partial cylindrical surface having a radius equal to the distance between axis 19 and the edge of the surfaces.

Figure 5:
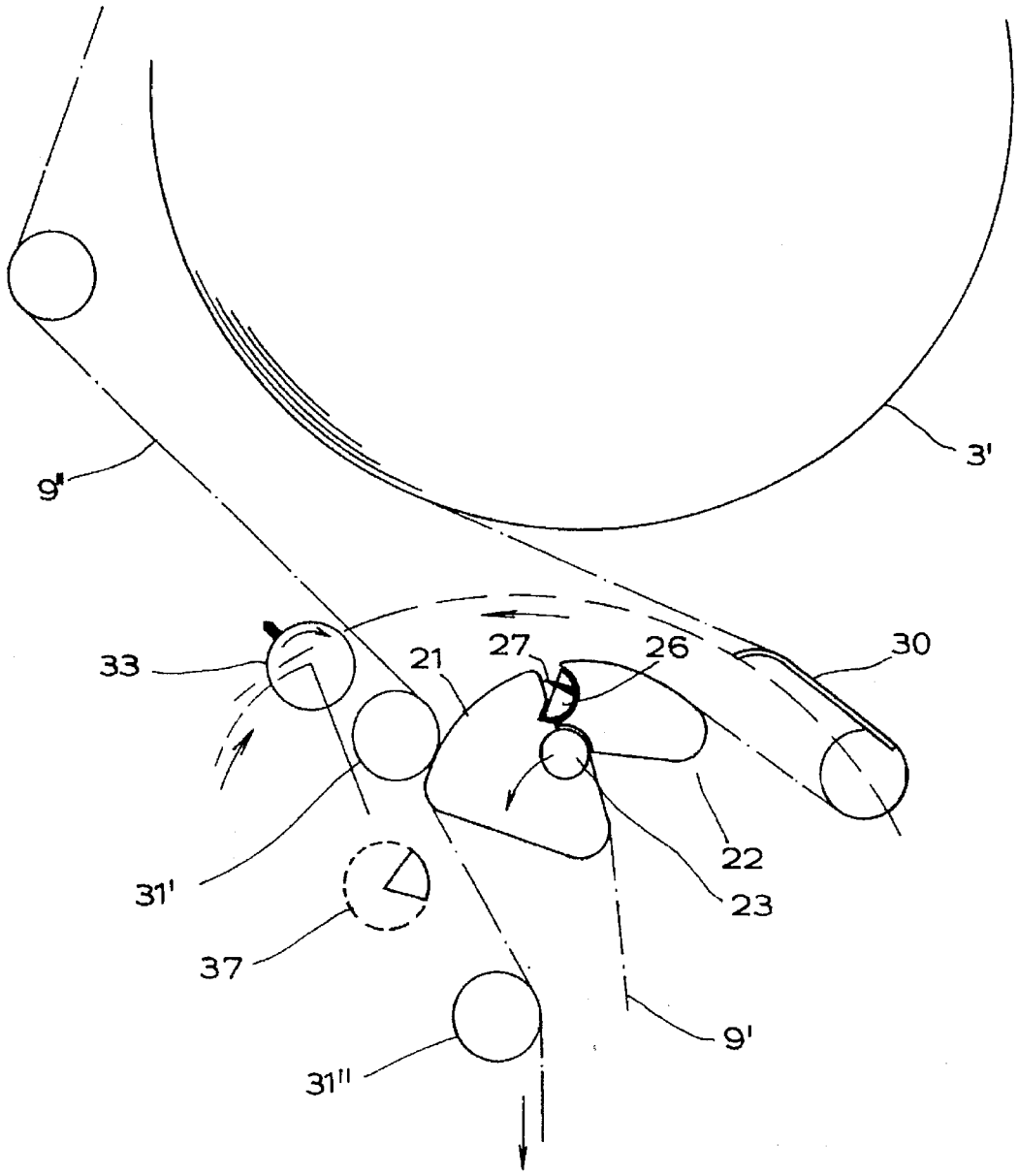

Referring now to FIG. 3, opposing element 22 further comprises a cut out region or recess 25, which is generally semi-circular in shape, located adjacent to indented surface 24. A holder 26, which is also preferably semi-circular in shape, is rotatably mounted within recess 25. A knife 27 for cutting web 9' is also mounted in recess 25. Knife 27 is preferably a perforation knife and is mounted in such a manner that rotation of holder 26 exposes knife 27. Furthermore, as shown in FIGS. 4 and 5, rotation of holder 26 in one direction closes a wedge shaped gap located between segment 21 and opposing element 22 when they are in the clamped position.

With web 9' clamped between segment 21 and opposing element 22, a loop-forming lever 28, which is mounted at one end thereof for rotation about an axis 29, begins to pivot toward web 9' such that the free end of loop-forming lever 28 engages web 9' to form a loop therein. Preferably, the free end of loop-forming lever 28 supports a deflection plate 30, a deflection roller or some equivalent thereof, which projects approximately at a right angle to loop-forming lever 28 to aid loop formation.

First and second nipping rollers 31' and 31" are located in spaced relation to one another and are spring biased into the circumferential path of the outer surface of segment 21 and outer surface of 22' of opposing element 22. First and second nipping rollers 31' and 31" are preferably mounted to the ends of first and second levers respectively. While web 9" is normally guided by nipping rollers 31' and 31", nipping rollers 31' and 31" also provide pressure to aid joining of webs 9' and 9" when splicing occurs.

In the disclosed embodiment of the present invention, a gluing head 32 is movably mounted to the packaging machine. Gluing head 32 can be moved within the loop of web 9', which is created by loop-forming lever 28, and used to apply glue to one surface of web 9'. This glue can be in the form of a plurality of beads of glue and is preferably hot glue. In an alternative embodiment, an element 37, located in the region between first and second nipping rollers 31' and 31", can be used to bond webs 9' and 9" together through heating, welding or embossing thereby eliminating the need to use a gluing head and an adhesive.

Finally, the present invention includes a means for cutting web 9" after splicing has occurred. Preferably the cutting means comprises a rotating knife 33 which is rotated at the same circumferential speed as the speed of web 9". To cut web 9", knife 33 is rotated about its axis and moved into the path of web 9" thereby cleanly cutting web 9". Optionally, knife 33 can be moved in to the path of web 9" along a circular arc via a pivotably mounted lever or the knife can approach web 9" linearly.

The operation of the above-described apparatus will now be described with reference to FIGS. 1 and 3–5. First, segment 21 is pivoted about axis 19 away from opposing element 22 to create a gap through which web 9' may freely pass. Web material gripper 10 then moves into engagement with web 9', which is wound on bobbin 3', such that roller 13 engages the outer surface of web 9'. The leading end of web 9' is lifted from the surface of the roll on bobbin 3' via knife 8 on slide 7 and slide 15 drives roller 14 along arm 11" of lever 11 toward roller 13. When rollers 13 and 14 make contact with the raised leading end thereof, web 9' is clamped between rollers 13 and 14. Cylinder 16 causes forked element 17 to engage one end of lever 11 thereby causing downward motion of arm 11', rollers 13 and 14 and web 9'. The downward movement of arm 11' guides the leading end of web 9' through the gap between segment 21 and opposing element 22.

When arm 11' reaches its lowest point, web 9' is positioned between segment 21 and opposing element 22 and the leading edge of web 9' will extend between, and be clamped by, a pair of roll off rollers 34. Segment 21 is then rotated about axis 19 to clamp web 9' between the friction roller 23 and complementary indented surface 24 of opposing element 22. Optionally, web 9' can also be clamped between the flat surface of holder 26 of opposing element 22 and a planar counter surface on segment 21.

Next, loop-forming lever 28 pivots into the path of web 9' thereby forming a loop in web 9'. Gluing head 32 then moves into the region within the loop and applies an adhesive to one surface of web 9'. Optionally, head 32 can apply double-sided adhesive strips or adhesive spots.

Preferably the glue is applied such that the bead extends along web 9' up to a point adjacent to holder 26. When holder 26 is subsequently rotated to expose knife 27, a portion of web 9' is drawn into the wedge shaped gap between segment 21 and opposing element 22. Thus, since the glued portion of web 9' previously extended to a point adjacent to holder 26, the glued portion of web 9' now extends into the seam between segment 21 and opposing member 22.

With segment 21 in a clamped position with opposing element 22, disc 20 rotates in the direction of web 9". After disc 20 has rotated to the point where web 9' is in engagement with web 9" between nipping rollers 31' and 31", knife 27, which was previously exposed by rotation of holder 26, cuts through web 9' and the end region of web 9' is bonded to web 9" by the second compressive action of nipping roller 31". Thus, web 9' is bonded to web 9" at the very end of web 9' leaving no portion which could bend up and be caught up on some part during subsequent transport. Since nipping rollers 31' and 31" are resiliently mounted into the path of the pivoting circle of the outer surfaces of segment 21 and opposing member 22, they ensure effective bonding between webs 9' and 9".

After webs 9' and 9" have been bonded, knife 33 rotates and is brought into the path of web 9" thereby cutting off the remainder of web 9". Additionally, segment 21 and opposing element 22 disengage and the excess leader portion of web 9' which has been separated from the rest of web 9' is disposed of by transport through roll-off rollers 34.

Next, segment 21 and opposing element 22 are rotated out of the path of spliced web 9' via rotation of disc 20 and lever 28 returns to an initial position so that web 9' now contacts, and is guided by, nipping rollers 31' and 31".

Turntable 1 can then be rotated such that bobbin 3' moves into the upper position which was previously occupied by bobbin 3" without adversely affecting the packaging process. Since bobbin 3' now supplies packaging material for packaging products, the now inoperative bobbin 3" can be removed from holding journal 2 and replaced with a full bobbin having a new web of packing material wound thereon. When web 9' eventually becomes nearly exhausted, web 9' can be spliced onto the web of packaging material wound onto the bobbin which replaces bobbin 3" in the manner described above.

While a preferred embodiment and a number of alternatives thereto have been shown and described, various other modifications and substitutions may be made thereto without departing from the spirit and scope of the invention. Accordingly, it is to be understood that the present invention has been described by way of illustration and not limitation.

What is claimed is:

1. In a packaging machine having first and second bobbins with first and second webs of packaging material wound on the first and second bobbins respectively, an apparatus for splicing the first and second webs of packaging material as they are unwound from the first and second bobbins, the paths of the first and second webs of packaging material defining a transporting plane, the apparatus comprising:

a. a first pivoting member pivotably mounted to the packaging machine, wherein said first pivoting member pivots about an axis substantially perpendicular to the transporting plane;

b. an opposing element in fixed relation to said first pivoting member, wherein said opposing element includes a second knife for cutting the second web of packaging material, and an outer surface which defines a partial cylindrical surface of a cylinder which is coaxial with said axis of said first pivoting member;

c. a second pivoting member pivotably mounted to the packaging machine, wherein said second pivoting member pivots about said axis of said first pivoting member, said second pivoting member pivoting between at least a retracted position, wherein said opposing element and said second pivoting member cooperate to define a gap for passage of the second web of packaging material, and a clamping position, wherein said opposing element and said second pivoting member cooperate to clamp the second web of packaging material therebetween, said second pivoting member including an outer surface which defines a partial cylindrical surface of a cylinder which is coaxial with said axis of said first pivoting member, said outer surface forming a cylindrical extension of said outer surface of said opposing element when said second pivoting member and said opposing element are in said clamping position;

d. a web-material gripper for feeding the leading end of the second web of packaging material through said gap defined by said opposing element and said second pivoting member when said second pivoting member is in said retracted position;

e. means for joining the first and second webs of packaging material;

f. first and second nipping rollers for guiding the first web of packaging material, said first and second nipping rollers being located in the pivoting circle of said outer surface of said second pivoting member such that the first and second webs of packaging material are pinched between said nipping rollers and said outer surfaces of said second pivoting member and said opposing element as said first pivoting member pivots; and g. a first knife for cutting the first web of packaging material after splicing has occurred.

2. An apparatus for splicing first and second webs of packaging material as recited in claim 1, wherein said second pivoting member further comprises a friction roller which pivots about an axis perpendicular to the transporting plane, and wherein said opposing element further comprises a cylindrical indented region adapted for engagement with said friction roller of said second pivoting member, when said second pivoting member and said opposing element are in said clamping position, such that the second web of packaging material is pinched therebetween.

3. An apparatus for splicing first and second webs of packaging material as recited in claim 2, wherein said web material gripper comprises a lever which is pivotably mounted for rotation about an axis perpendicular to the transporting plane such that one end of said lever is capable of engagement with the second web of packaging material before it has been unwound from the second bobbin, and a means for clamping the leading end of the second web of packaging material after it has been lifted off of the second bobbin.

4. An apparatus for splicing first and second webs of packaging material as recited in claim 3, wherein said means for clamping the leading end of the second web of packaging material comprises first and second friction rollers which can be pressed against one another to clamp the second web of packaging material therebetween.

5. An apparatus for splicing first and second webs of packaging material as recited in claim 4, wherein said web material gripper further comprises a counterweight mounted on said lever for urging rotation of said lever about said axis.

6. An apparatus for splicing first and second webs of packaging material as recited in claim 5, further comprising a pair of roll-off rollers for removing the detached portion of the second web of packaging material after it has been cut with said second knife of said opposing element, and wherein said web material gripper guides the second web of packaging material between said roll-off rollers.

7. An apparatus for splicing first and second webs of packaging material as recited in claim 6, wherein said first and second nipping rollers are resiliently biased into the pivoting circle of said outer surface of said second pivoting member.

8. An apparatus for splicing first and second webs of packaging material as recited in claim 7, wherein said means for joining the first and second webs of packaging material comprises a loop-forming lever for forming a loop in the second web of packaging material, and a gluing head which can be moved into the region within the loop created by said loop forming-lever for applying an adhesive to the second web of packaging material.

9. An apparatus for splicing first and second webs of packaging material as recited in claim 8, wherein said loop-forming lever is pivotably mounted at one end thereof for rotation about an axis, and wherein the opposite end of said loop-forming lever can be pivoted into the path of the second web of packaging material to create a loop therein.

10. An apparatus for splicing first and second webs of packaging material as recited in claim 9, wherein said second pivoting member further comprises a clamping surface, and wherein said opposing element further comprises a holder having a circular segment shape rotatably mounted to said opposing element for rotation about an axis which is parallel to said axis of said first pivoting member, for clamping said second web of packaging material between said holder and said clamping surface of said second pivoting member.

11. An apparatus for splicing first and second webs of packaging material as recited in claim 10, wherein said second knife of said opposing element is exposed by rotation of said holder.

12. An apparatus for splicing first and second webs of packaging material as recited in claim 11, wherein said second pivoting member further comprises a cut-out region adjacent to said clamping surface, wherein said cut-out region of said second pivoting member and said holder of said opposing element cooperate to define a gap therebetween, and wherein said holder of said opposing element can be rotated into said cut-out region of said second pivoting member such that at least a portion of the second web of packaging material is drawn into said gap as said holder is rotated.

13. An apparatus for splicing first and second webs of packaging material as recited in claim 1, wherein said web material gripper comprises a lever which is pivotably mounted for rotation about an axis perpendicular to the transporting plane such that one end of said lever is capable of engagement with the second web of packaging material before it has been unwound from the second bobbin, and a means for clamping the leading end of the second web of packaging material after it has been lifted off of the second bobbin.

14. An apparatus for splicing first and second webs of packaging material as recited in claim 13, wherein said means for clamping the leading end of the second web of packaging material comprises first and second friction rollers which can be pressed against one another to clamp the second web of packaging material therebetween.

15. An apparatus for splicing first and second webs of packaging material as recited in claim 1, wherein said first and second nipping rollers are resiliently biased into the pivoting circle of said outer surface of said second pivoting member.

16. An apparatus for splicing first and second webs of packaging material as recited in claim 1, wherein said means for joining the first and second webs of packaging material comprises a loop-forming lever for forming a loop in the second web of packaging material, and a gluing head which can be moved into the region within the loop created by said loop forming lever for applying an adhesive to the second web of packaging material.

17. An apparatus for splicing first and second webs of packaging material as recited in claim 16, wherein said loop-forming lever is pivotably mounted at one end thereof for rotation about an axis, and wherein the opposite end of said loop-forming lever can be pivoted into the path of the second web of packaging material to create a loop therein.

18. An apparatus for splicing first and second webs of packaging material as recited in claim 1, wherein said second pivoting member further comprises a clamping surface, and wherein said opposing element further comprises a holder having a circular segment shape rotatably mounted to said opposing element for rotation about an axis which is parallel to said axis of said first pivoting member, for clamping said second web of packaging material between said holder and said clamping surface of said second pivoting member.

19. An apparatus for splicing first and second webs of packaging material as recited in claim 18, wherein said second knife of said opposing element is exposed by rotation of said holder.

20. An apparatus for splicing first and second webs of packaging material as recited in claim 19, wherein said second pivoting member further comprises a cut-out region adjacent to said clamping surface, wherein said cut-out region of said second pivoting member and said holder of said opposing element cooperate to define a gap therebetween, and wherein said holder of said opposing element can be rotated into said cut-out region of said second pivoting member such that at least a portion of the second web of packaging material is drawn into said gap as said holder is rotated.

* * * * *